US005255440A

United States Patent [19]

Rogers

[11] Patent Number: 5,255,440

[45] Date of Patent: Oct. 26, 1993

[54] ARCHERY ALIGNMENT METHOD

[76] Inventor: Karl G. Rogers, 308 E. 1700 South, Kaysville, Utah 84037

[21] Appl. No.: 831,554

[22] Filed: Feb. 5, 1992

[51] Int. Cl.[5] ..... F41G 1/467

[52] U.S. Cl. ..... 33/265; 124/87

[58] Field of Search ..... 33/265, 258; 124/86, 124/87, 88, 89, 91

[56] References Cited

U.S. PATENT DOCUMENTS

| | | | |
|---|---|---|---|
| 2,001,470 | 5/1932 | Nyvall | 273/107.5 |
| 2,788,701 | 4/1957 | Browning | 33/265 |
| 3,320,670 | 5/1967 | Ambraziatis | 33/46 |
| 3,368,282 | 2/1968 | Gibson et al. | 33/265 |
| 3,524,440 | 8/1970 | Hill | 124/24 |
| 3,641,675 | 2/1972 | Funk, Jr. | 33/265 |
| 3,715,807 | 2/1973 | Heffer | 33/265 |
| 3,861,051 | 1/1975 | Killian | 33/265 |
| 4,167,333 | 9/1979 | Young et al. | 33/265 |
| 4,178,693 | 12/1979 | Smith | 33/265 |
| 4,507,874 | 4/1985 | Brown | 33/265 |
| 4,646,444 | 3/1987 | Cary | 33/265 |
| 4,733,474 | 3/1988 | Cary | 33/265 |
| 4,979,309 | 12/1990 | Oligschlaeger | 33/265 |

*Primary Examiner*—Thomas B. Will

*Attorney, Agent, or Firm*—James L. Sonntag

[57] ABSTRACT

Disclosed is an archery alignment device for a bow with a tensioned bow string drawn by an archer comprising a mount adapted to mount the device on the bow, a reflector attached to the mount such that when the device is mounted on the bow, the reflector is adapted to reflect an image of at least a portion of the archer and an image of at least a portion of the string to the aiming eye of the archer while the archer is in shooting position. An archer reference point is on the reflector that is discernable by the archer by a distinctive feature in the reflected image of the archer. An alignment point is proximate to the reflector, which is adapted to align with the archer reference point. A string axis is on the reflector in substantially vertical alignment, which is discernable by the archer by a distinctive portion in the reflected image of the string. A surface reference is adapted to be aligned with the string axis and is defined by a distinctive feature proximate to the reflecting surface.

3 Claims, 6 Drawing Sheets

ARCHERY ALIGNMENT METHOD

FIELD OF THE INVENTION

This invention relates to alignment devices for archers.

BACKGROUND OF THE INVENTION

The shooting of an arrow from a bow has been the subject of study, prompted to a large degree by the difficulty for an archer to consistently place an accurate shot. This difficulty is due largely to the many variables involved in shooting an arrow with a bow. Many problems associated with learning to shoot accurately stem from the fact that the "system" for shooting the arrow includes not only the bow and arrow but also the archer. Each archer is different, and the shooting position for an archer will inevitably vary some from shot to shot, resulting in inconsistent effects on the accuracy of each shot.

Among the factors of an archer's shooting position that affect accuracy is a consistent draw. The draw not only affects the range, by the draw length, but also the direction of the flight of the arrow by the direction of the draw. Accordingly, successive draws of the arrow must be pulled back in the same direction and to the same distance from the grip for consistent shots. Many archers attempt to achieve some consistency by use of an anchor or "nock point". An anchor point is a point on the archer, usually the face, such as a cheek, nose, tooth, a point on the lip, etc., to which the archer will draw the string. However, this may not ensure consistently accurate shots. If, for example, the archer changes the position or angle of his head from shot to shot, this may change the position of anchor point and the direction of the draw, which will affect the direction of arrow flight.

Another factor affecting accuracy is the way in which the archer holds the grip on the riser. If the archer "torques," i.e., applies a moment about the vertical axis of the riser by an improper grip, this moment will be translated into a slight rotation of the bow. This rotation will force the ends of the bow limbs to one side, which in turn puts a lateral force on the base of the arrow when it is released. This lateral force will drive the back of the arrow to one side as it leaves the bow. Torque can be difficult to detect, since the archer can properly draw the arrow to the anchor point and aim the arrow, but inadvertently apply a torque on the bow. In addition, only a small torque is necessary to adversely affect shot accuracy. Since the only indication of torque is the slight rotation of the bow at the riser and the slight displacement of the bow limb ends, and the rotation is often small, torque cannot normally be perceived by the archer.

Often a marker or "button" on the string is used as a reference to bring the archer to a consistent anchor point when the bow is drawn, e.g., by bringing the button to the nose. In addition, peep sights are frequently used to assist in providing a good anchor point, as well as provide an aiming device. A peep sight is mounted on the string and comprises an aperture, such as provided by a device with a small aperture placed in the strands of the string, through which the archer can peer while the bow is drawn. Although these devices, particularly when used in combination with each other, can help in achieving a consistent anchor point, they provide no means for detecting torque, and thereby minimizing torque to the riser. In addition, a peep sight with a small aperture is most effective for aiming and anchor point alignment; but such a small aperture renders the sight difficult or impossible to use in low-light situations, such as early morning or late dusk. Furthermore, the peep sight is directly in the view of the archer when sighting, obstructing his view, which compounds the difficulties in low light conditions. In addition, the peep sight and button must be changed every time the string is changed. When this happens, the archer must adjust or "recalibrate" his shooting position to compensate for the unavoidable, although slight, change in position of the peep sight and button. This adjustment, which is both a physical and psychological adjustment, results in the archer not achieving his normal accuracy until he becomes accustomed to the new string.

In additkion to peep sights, there are various sights in the prior art that are used to sight the arrow. While variations in the archer's position can to some extent be determined by use of these sights, they either do not detect both anchor-point and torque problems, or they cannot distinguish between them. For example, for some sights with the arrow drawn to an improper anchor point, the archer may see some misalignment, but the same symptom may be caused by torquing, which, from the view of the archer, shows the same or similar misalignment in the sight. The archer is then unable to determine whether to compensate for the misalignment by changing the anchor point or by changing torque on the grip. In addition, the archer may be able to align and aim with the sight, while applying a torque and using a misplaced anchor point. In this case, even though the bow is perceived by the archer as properly drawn and aimed, the shot will not be accurate. Thus, without the ability to determine torque and anchor-point displacement independently from each other, the archer cannot know whether he is attaining a consistent shooting position by using these prior art sights.

Another problem with many prior-art sights is that while some can be adapted to detect torque, they cannot detect a small torque. Even a very slight torque on the riser, for example, caused by changing the position of the fingers, or opening or closing hand grip, can affect the flight direction of the arrow. These slight changes in torque are usually so slight and cause such a small displacement of the sight, that the displacement is not easily perceived by the archer.

Another problem with some prior-art sights is that they replace the normal sights on the bow and require that the archer relearn his sighting technique using a new type of sight. Archer's frequently use a sighting pins placed on a mounting bracket extending from the riser, with several sighting pins provided for different ranges or shooting distances. To aim, the archer aligns the appropriate pin with the target. Sighting pins can be used with peep sights, but many sights, particularly reflecting sight, replace or supersede conventional reference-type sights, such as sighting pins.

Another problem is that some sights are bulky and complex, which decreases the durability of the sight. This allows the sight to be easily damaged or knocked out of alignment, as compared to conventional reference-type sights. Particularly for those reflecting sights that are mounted in place of sighting pins, a bow with a damaged or misaligned sight will be without a working sight and totally useless to the archer.

A further problem with many sights, particularly with most reflective sights with multiple reflected images and with a light path through a narrow housing or aperture, is that they are difficult or impossible to use in low light conditions, such as early morning, or late dusk. This can be a severe handicap to bow hunters who frequently hunt under these conditions.

U.S. Pat. No. 3,320,670 to Ambraziatis discloses an archer's bow sight comprising a reflection means that reflects an image of the arrow tip to the archer and an alignment means connected to the reflecting means for aligning the arrow in relation to a target. The alignment means and reflection means are positioned such that the tip of the arrow is reflected by the reflection means with the image of the tip covered by or aligned with alignment means. The bow is aimed by aligning the alignment means on the target and the reflected tip image. The sight may be lowered to raise the trajectory of the arrow or adjusted to the left or right to compensate for windage. The adjustments are empirically determined by the archer after a number of test shots, and adjustment has to be made for each range. (col 3, lines 63, 64, and 73 to col. 4, line 2; col. 4, lines 23 to 31). While the Ambraziatis sight may show some bow and archer misalignment, it is very insensitive to detection of torque because the displacement of the arrow due to torquing is not great. In addition, since the arrow point is close to the reflection means, a small displacement due to torquing or to an anchor point misplacement would probably not be perceived by the archer.

U.S. Pat. No. 3,715,807 to Heffer discloses a bow sight comprising a mirror to reflect an image of the arrow to the archer with a sighting means attached to the mirror to align with a target. The preferred sighting means is a vertical filament against the mirror face extending into the target picture. When the image of the arrow is centered in the mirror, the flight of the arrow will lie in the vertical plane, which contains the arrow centerline and vertical cross-hair. A blade is moved along the length of the filament in the target picture to adjust for range. The bow is aimed by aligning the target with the crossed filament and blade. This sight is also inadequate in detecting and distinguishing bow misalignments, and sometimes may contribute to poor shooting position. If the bow is torqued, the displacement of the arrow in the bow is very small, and its image is too close to the mirror for the displacement to be practically perceived by the archer. In addition, a change in range is accomplished with this sight by moving the bow/arrow combination with respect to the aiming eye, which requires that the archer change his anchor point for each range. Thus, this sight requires the archer to change his shooting position from shot to shot, and, therefore, prevents the archer from developing a correct shooting position which is used consistently from shot to shot. An object of the Heffer sight is to provide a sight that is independent from the physical characteristics of the archer, which requires the archer to adjust his shooting style to fit the sight, instead of permitting the archer to shoot with his most comfortable style. Another problem with this sight is that the surface of the arrow is a poor reference for showing small misalignments, as the arrow axis would have to have a large misalignment to show a perceivable deviation of the arrow image from the center of the mirror.

U.S. Pat. No. 2,001,470 to Nyvall discloses a bow sight of the "periscope-type" comprising an upper and lower mirror on a generally vertical alignment. The image of the target is reflected from one mirror to the other which reflects the image to the archer. The lower mirror is lined or reticulated, such that the arrow is aimed by aligning the image of the target on the lines of the lower mirror. (page 3, col. 1, lines 14 to 49) An inherent problem with periscope-type sights is that they have the inability to independently indicate and distinguish between torque and anchor point problems. For example, torquing or a misplaced anchor point will both show a misalignment of the sight, with no indication to the archer of the proper corrective measures to take to assume a correct shooting position. In addition, since the mirrors are close together, and particularly since only one mirror is marked with reference points, only a large misalignment from torque or anchor-point misplacement would be perceivable by the archer through the sight. Another inherent problem with the periscope sights is that one must aim through a double mirror system, which can clutter the view of the archer as he sights on the target, adding visual confusion and diminishing the ability of the archer to quickly assess the target and the flight path of the arrow. In addition, under low-lighting conditions, the double reflected image of the target image may be difficult to see through the sight rendering the sight impossible or difficult to use.

U.S. Pat. No. 3,524,440 to Hill discloses another periscope-type archer's bow sight comprising an upper and lower mirror, with cross-hairs or an equivalent aligning device mounted on one of the mirrors. The mirrors are aligned vertically forward of the bow. The lower mirror is focused on the target, while the upper mirror is focused in the lower mirror and reflects the target image to the archer's eye. The mirror with the cross-hairs may be adjusted to compensate for distance and windage. The Hill bow sight is designed primarily to compensate for distance and windage and requires adjustment each time the distance or windage change. Hill discloses that the position of axis of the mirrors ahead of the bow allows the archer to perceive changes in torque by observing the mirrors. While torque will misalign the mirrors from the archer's viewing perspective, so will anchor-point problems, so that this sight has the same inherent problems of all periscope-type sights. Therefore, even when the Hill sight is aimed and aligned, it does not ensure that the bow/archer position is correct.

U.S. Pat. No. 4,979,309 to Oligschlaeger discloses another periscope sight with a target image mirror and a fixed reflected image mirror adapted for range finding. An aiming point is linked with the target image mirror such that the reflected image of the target and the actual image of the target can be placed in vertical alignment. The bow is aimed by placing the aiming point over actual image of the target while in this vertical alignment. The sight compensates for differing distances when adjusted and allows the archer to shoot at an unknown distance. The alignment device uses a cam apparatus and requires different cams for different archery equipment and archers. However, this sight is much like the Hill sight above, and accordingly suffers from the same inherent problems of periscope-type sights, particularly the inability to independently determine and distinguish anchor-point and torque problems.

Other periscope-type sights in the art are described in U.S. Pat. No. 4,507,874 to Brown, U.S. Pat. No. 4,178,693 to Smith, and U.S. Pat. Nos. 4,646,444, and 4,733,474 to Cary. While these sights may have improved adjustment and range-finding abilities and may be easier for an archer to use than other such sights, they all have the inherent problems of periscope-type sights.

Besides the problems of the above prior-art sights of not adequately indicating misalignments in the archer's shooting position, many suffer from the problem of being too bulky, too heavy, or unwieldy. This is particularly true for bow hunting where the shooting conditions are usually not ideal, and the archer may have to move and shoot quickly. In addition, any bow accessory should preferably permit the parallel use of sights that the archer has normally on the bow, such as the conventional multiple range pins. This allows the archer to shoot in a manner in which he is accustomed without the necessity of learning new or elaborate sighting techniques. In addition, this allows for a backup system if the device is damaged or misaligned by allowing use of the bow with its normal sights without the device.

OBJECTS OF THE INVENTION

It is, therefore, an object of the invention to provide an alignment device to enable an archer to detect both anchor-point and torque problems independently of each other.

It is also an object of the invention to train the archer by use of the alignment device to use the correct anchor point and to not apply torque to the riser.

It is also an object of the invention to provide an alignment device that allows the archer to detect very small anchor-point and torque misalignments.

It is also an object of the invention to provide an alignment device that does not interfere with or compromise the archers's normal shooting technique.

It is also an object of the invention to provide an alignment device that allows parallel use of independent sights; thus, not making the archer fully dependent on a new sighting method.

It is also an object of the invention to provide an alignment device that allows an archer to normally aim and shoot the bow, without requiring the archer to use the device. Accordingly, under low light conditions, the archer may be unable to use the device, but is able to rely upon the training effect of the device to maintain a correct shooting position.

It is also an object of the invention to provide an alignment device that is light and does not interfere with operation or movement of the bow when in use.

Further objects of the invention will become evident in the description below.

SUMMARY OF THE INVENTION

An embodiment of the invention is an archery alignment device for a bow with a tensioned bow string drawn by an archer comprising;

(a) a mounting means adapted to mount the device on the bow, (b) a reflecting means attached to the mounting means such that when the device is mounted on the bow the reflecting means is adapted to reflect an image of at least a portion of the archer and an image of at least a portion of the string to the aiming eye of the archer while the archer is in shooting position, (c) an archer reference point defined by a distinctive feature in the reflected image, (d) an alignment point proximate to the reflecting means adapted to align with the archer reference point in the reflected image, (d) a string axis in substantially vertical alignment defined by a distinctive portion in the reflected image of the string, and (f) a surface reference adapted to be aligned with the string axis and defined by a distinctive feature proximate to the reflecting surface.

The mounting means may be any suitable means for attaching the alignment device on the bow, preferably adjacent to the riser. Preferably the mounting means is adapted for attachment to a sight bar or to the riser and constructed so that the alignment device may be easily attached and removed.

Bows upon which the alignment device can be used are any of the bows that comprise a riser, limbs, and a tensioned bow string that is drawn by the archer to provide the force to propel the arrow. Examples include, but are not limited to, long bows, recurved bows, reflexed bows, and compound bows. Typically, the axis of the riser is generally vertical when the bow is held in shooting position, although it may be angled from the vertical. Accordingly, unless otherwise indicated, "vertical" as used herein, refers to the general direction of alignment of the axis of the riser.

The reflecting means may be any means capable of returning an image to the archer, e.g., by reflection, or refraction, or a combination thereof. Suitable reflecting means include but are not limited to, glass or plastic surfaces that are reflecting, by suitably smooth substrates coated with a reflecting medium, polished metal surfaces, prisms, or any of these in combination. The reflecting means is preferably a planar reflecting surface. It may also be concave or convex or include magnifying, or wide-angle elements to magnify or broaden the image, or comprise multiple reflecting surfaces. While not preferred, the reflecting means may distort the image, as long as a recognizable part of the archer is included in the image sufficient to perceive an archer reference point.

The "archer reference point," as defined herein, is a point on the reflected image that is sufficiently distinctive to use as a reference point, and that is in a relatively fixed position to the aiming eye when the archer is in a shooting position. Accordingly, the reflected image is preferably of a portion of the archer's head, which as used herein includes the head and neck, but may be of other reflected portions of the body that are in a relatively fixed position to the aiming eye, as described above. This also includes objects that are on the body relatively near to and in a fixed position relative to a suitable portion of the archer's body, e.g., certain articles of clothing, or a ring on the drawing hand. An archer with an unusual shooting position may prefer a reflected image from a part of the body different than the head, particularly if his anchor point is not on or near the head or neck, e.g., the chest. In such a case, the reflected image may more appropriately be from a point near the anchor point.

In a less preferred embodiment of the invention, the alignment point is aligned with a string reference point. In this embodiment, the reflecting means shows a reflected image of the string, preferably of the string above the archer's head. A "string reference point," is defined by a discernable point on the string image. This embodiment functions essentially the same as the embodiments using an archer reference point, except a different reference point is aligned with the alignment point, i.e., the string reference point instead of an archer reference point. The string reference point may be defined by a distinctive mark on the string that is easily perceivable in the reflected image of the string.

The reflecting means is preferably small, as only a small recognizable portion of the archer need be in the reflected image, and the image need only contain a distinctive point that can be repeatedly and reproducibly recognized for use as an archer reference point by the archer. The distinctive point may be a pupil of an eye, a tear duct, a mole, end of an eye-brow, or the like. An eye, particularly the center of the pupil of the aiming eye, is preferred as it automatically provides a bulls-eye image, which is easily and quickly recognized by most archers.

The alignment point proximate to the reflecting means is to provide a point on the alignment device that can be reproducibly recognized by the archer and aligned by the archer as he views the reflected image with his aiming eye with the archer reference point in the reflected image. By "proximate" is meant that the alignment point is on or close enough to the reflecting means to show essentially no perceivable parallax between the alignment point and the reflecting means to the archer in the shooting position. For example, the alignment point-reflecting means combination may be a mirror with a point in the reflecting plane of the mirror or on the mirror surface defined by cross-hairs or an etched mark or marks. The alignment point-reflecting means combination may also be a mirror with a shape mounted directly in front of the reflecting surface. The shape may be any suitable shape, such as those used in aiming devices, e.g., a small sphere, annular bulls-eye, or cross-hairs. The alignment point may also be defined without a special mark, but by use a part of the inherent structure of the reflecting means, such as the edge or corner of a mirror or prism. An alignment point should be capable of being seen and discerned in a reproducible manner while in shooting position and while looking at the reflected image from the reflecting means.

In addition to the reflected image with the archer reference point, the alignment device also reflects a portion of the string to the archer's aiming eye to show a "string axis." The string axis is defined by a distinctive portion in the reflected image of the string that defines a generally vertical axis in the reflected image, such as the edge of the reflected string-image. The string axis is aligned horizontally with a "surface reference," which is defined by a distinctive feature proximate to the reflecting surface of the alignment device. The distinctive feature may be a distinctive point in the reflected image apart from the string image which is essentially constant from one shot to another, e.g., a portion of the reflected image of the archer, such as an edge of an iris, or be a distinctive point proximate to the reflecting surface itself, such as etched or painted marks, or an edge of a mirror. Since the surface reference is aligned with the string axis, which is generally vertically disposed, the surface reference can be either a point, or a vertically aligned line, axis, or series of points capable of horizontal alignment with the string axis. By "proximate" is meant that the surface reference is on or close enough to the means reflecting the string portion to show essentially no perceivable parallax to the archer in shooting position between the surface reference and the means reflecting the string portion. The surface reference may be the same or different from the archer reference point.

The reflecting means is preferably a single reflecting surface or prism, which provides both the reflected image of the string portion and the reflected archer-image with the archer reference point. However, the reflecting means may comprise an additional string reflecting means, e.g., a reflecting surface or prism at a different angle. This double reflector embodiment would be suitable for an archer with a shooting position that does not permit the string and the archer reference point to be in the same reflected image.

As further explained below, the alignment of the string axis with the surface reference provides another reference for alignment, which not only improves alignment of the shooting position, but allows the archer to distinguish between torque and anchor-point misalignments. Optionally, a distinctive mark on the string is also visible in the reflected portion in the string. This permits vertical alignment of the string mark and a distinctive mark on the reflecting surface, which allows the archer to determine the length of the draw. If draw length is of primary concern, a reflecting means with an additional string reflecting means (as described above) is preferred. With two reflecting surfaces, draw length can be more easily detected, since a string mark further from the anchor point can be shown than is possible with a single reflecting surface.

The present alignment devices derives its advantages to a large degree from the fact that it is designed primarily to assist the archer to conform to a correct shooting position by aligning the relative positions of the components of the shooting system, i.e., the archer, bow, arrow, and string, rather than being a sight. This contrasts with the above prior-art sights, which as a primary function aim the arrow and/or bow toward a target, and as a secondary consideration may attempt alignment of the relative positions of the archer, bow, string and arrow. The problem with the target-aiming approach of known prior-art sights is that to be effective, a device must detect alignment of the arrow, the bow, the string, the arrow and archer's position to the target, and to each other, which comprehends several variables and degrees of freedom. To avoid undue complexity, the above prior-art devices sacrifice the ability to measure all the variables necessary to adequately show a correct shooting position.

The approach of the present alignment device of the invention is to define reference points on the shooting system, the archer/bow/arrow/string, and to correctly align these points. After the system is correct, the archer in the correct shooting position can aim the arrow with a sight. Without the requirement that the present alignment device align with a target, the alignment device can be more easily adapted to align the archer into the correct position. The use of body, bow, string and arrow reference points instead of the target as a reference, reduces the number of alignment variables for the device to comprehend, allowing a simple device to show more information about the shooting position.

In addition to the superior ability to indicate a correct shooting position to the archer, the present invention provides other advantages over the above prior-art sights. The present alignment device is not essential to aim and shoot. The archer may ignore the alignment device where use of the device may be unduly distracting, such as for quick shots, in very poor light, or difficult shooting environments. In addition, the archer uses the target sighting system to which he is accustomed and he isn't required to relearn his sighting and shooting method or change his shooting position. It has also been found the repeated use of the device provides a training effect, so that even when the archer chooses not to use the alignment device, his shooting is more accurate than it would be before he started using it.

Another advantage is that the archer can easily adjust and calibrate the present alignment device. Since the device relates only to alignment of the bow, arrow, string and archer, the device can be calibrated without requiring repeated steps of shooting arrows toward a target and recalibrating. Thus, adjustment can be done at leisure and a closer alignment to achieve a correct shooting position can be more easily achieved.

DETAILED DESCRIPTION OF THE INVENTION

Figure 1:
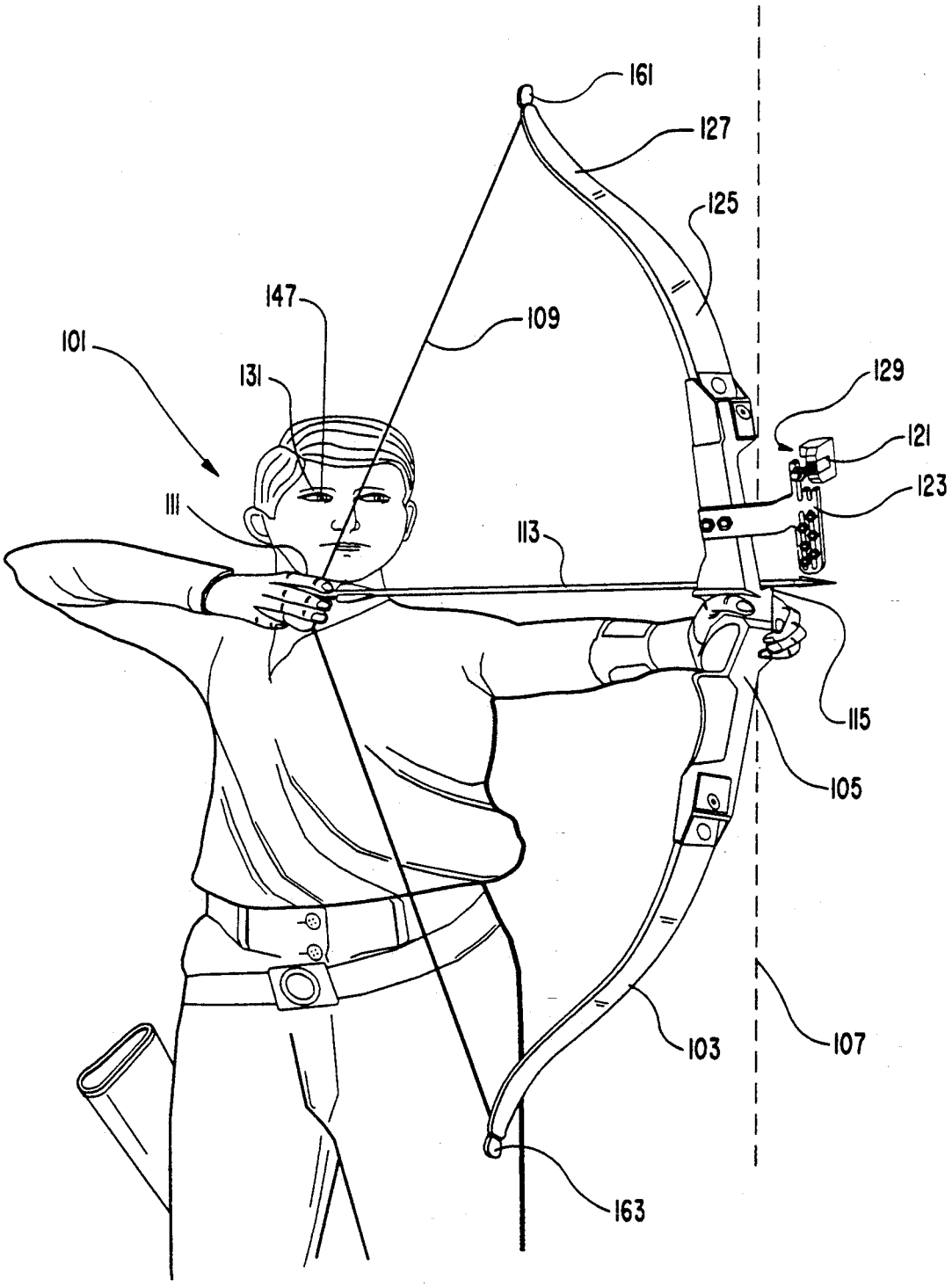
FIG. 1 is a view from the front and right side of an archer in shooting position with a bow including a device of the invention.
Figure 2:
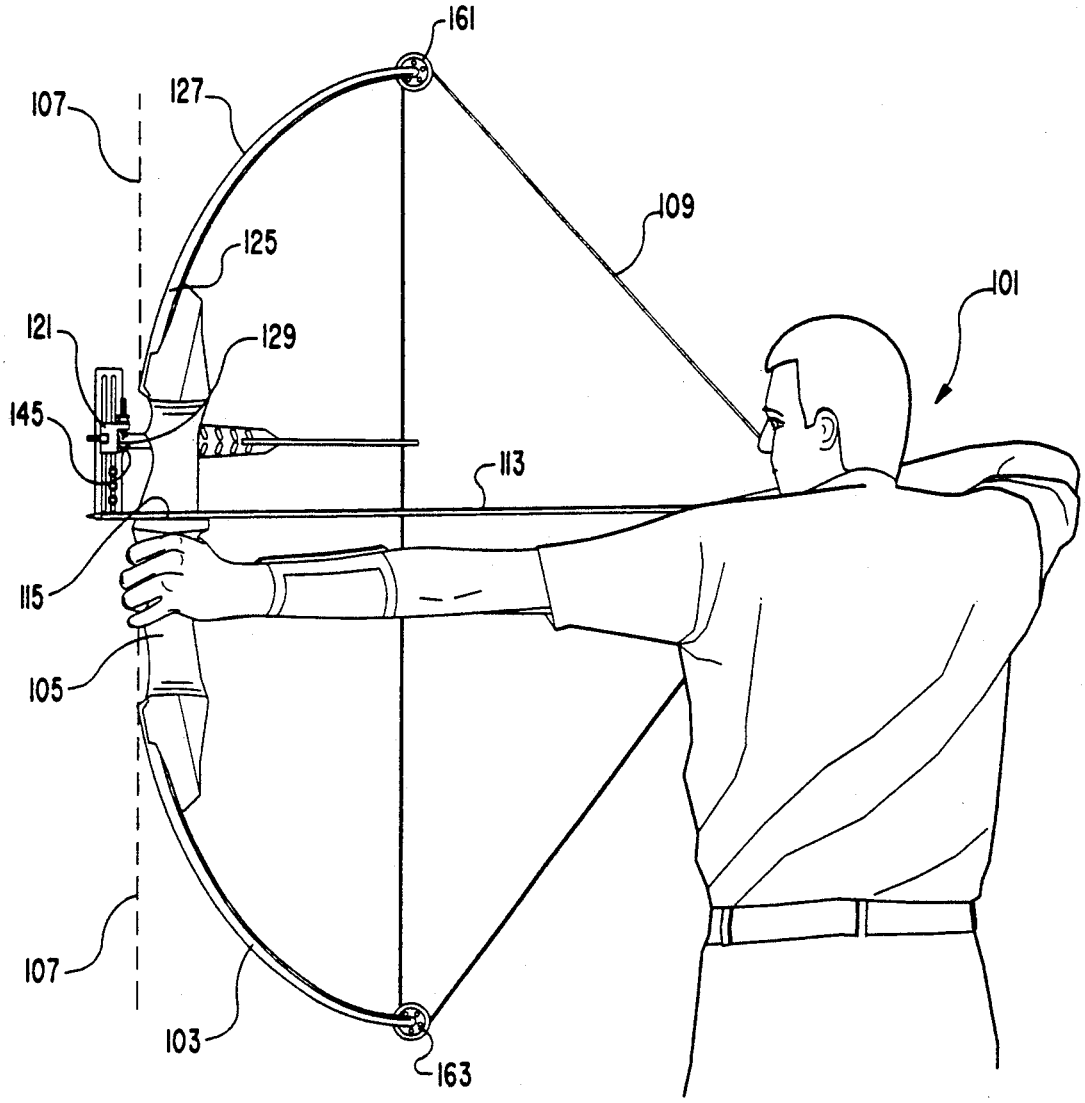
FIG. 2 is a view of an archer similar to FIG. 1 from the left side.

In FIGS. 1 and 2 is illustrated an archer 101 in a shooting position, holding a bow 103 by its riser 105 with the axis 107 of the riser in a generally vertical position. The bow string 109 is drawn to an anchor point 111 on the archer's face, and an arrow 113 extends forward from the drawn string 109, passing near the riser 105 and the arrow shelf 115 of the bow.

An alignment device 121 according to the invention is mounted, via a mounting means 123, below the face or front 125 of the upper limb 127. Referring to FIGS. 1 and 2, the alignment device 121 comprises a reflecting means 129, provided in this embodiment by a mirrored surface. The reflecting means 129 is aligned such that a reflected image of a portion of the archer is reflected to the aiming eye 131 (here the right eye) of the archer 101 while the archer is in shooting position.

Figure 3:
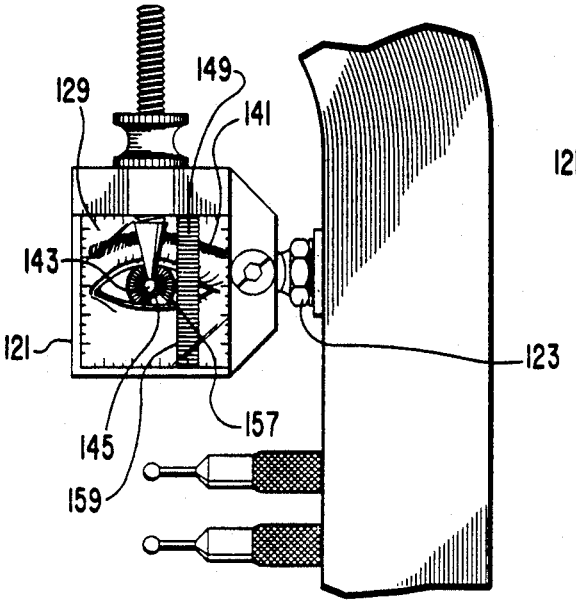
FIG. 3 is a view of a device of the invention from the view of an archer, when the archer is in a correct shooting position.

In FIG. 3 is shown the alignment device 121 in FIG. 1 from the archer's viewpoint. A reflected image 141 of a portion of the archer, here a portion of the head around the right eye, is seen reflected from the reflecting means 129 of the alignment device 121. An archer reference point 145 in the reflected image 141 is defined by a distinctive feature in the reflected image 141, which here is the center of the pupil of the eye.

An alignment point 143 is proximate to the reflecting means 129. In this example the alignment point 143 is defined by a small sphere mounted directly in front of the reflecting means, as further illustrated below in FIGS. 8 to 10*d*.

In FIG. 3, the reflecting means 129 is aligned to additionally return to the archer's aiming eye a reflected image of a portion of the bow string 149. Here the reflected image of the bow string 149 is provided by the same reflecting surface showing the portion of the archer with the archer reference point 145. The reflected image of the bow string 149 is superimposed over the reflected image of a portion of the archer. On the reflecting surface is a surface reference 157, which is here the right edge of the reflected image of the iris. The surface reference 157 is aligned with a string axis 159 defined by a distinctive portion of the reflected image of the string, which is here the left edge of the reflected image of the string 149.

Figure 4:
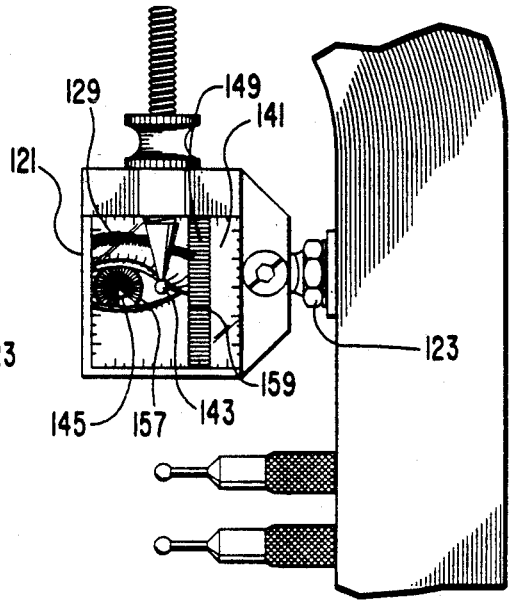
FIGS. 4, 5, and 6, are views similar to FIG. 3 except that they show a reflected image when the archer is in an incorrect shooting position.
Figure 5:
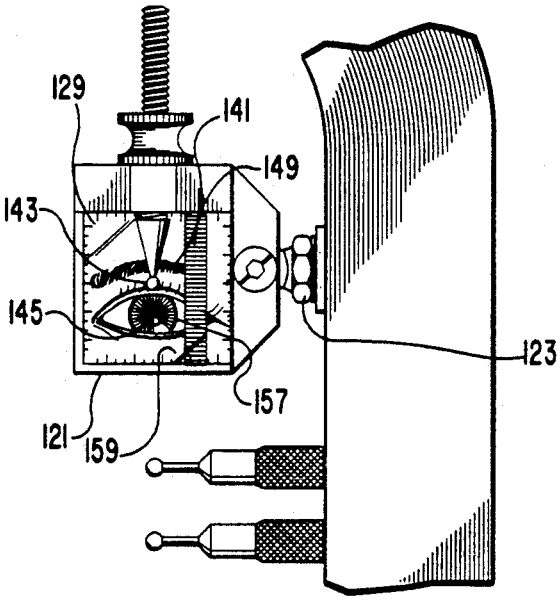
Figure 6:
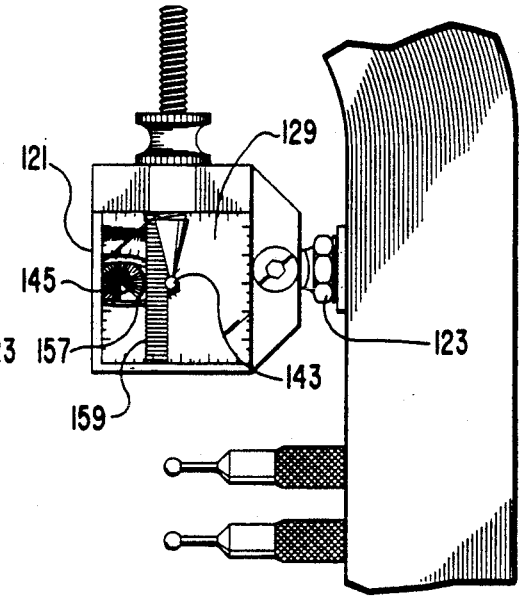

The alignment of the surface reference 157, and the string axis 159 permits the archer to perceive and distinguish between anchor-point misalignment and torque problems. Referring to FIGS. 1 and 3, the reflected image of the string 149 in the alignment device 121 of the invention, conveys to the archer 101 information about the relative position of the drawn string 109 to the reflecting means 129 and the archer's aiming eye 131. For example, referring to FIG. 4, the archer reference point 145 is shown to the left of the alignment point 143. This generally indicates that the anchor point is placed too far to the right. In FIG. 5, the archer reference point 145 is centered under the alignment point 143, which usually indicates that the anchor point is too high. In FIG. 6, the string axis 159 and surface reference 157 are aligned, while the archer reference point 145 is left of the alignment point 143. The alignment of the string axis 159 and surface reference 157 indicates that the anchor point is correctly placed, thereby indicating that the misalignment of the archer reference point 145 and the alignment point 143 is due to a torque on the riser (here counter clockwise as seen from above).

Expressed otherwise, if the archer views the reflected image in the alignment device and the archer reference point and the alignment point are not properly aligned, this indicates an improper alignment of the archer's aiming eye, the reflecting surface and the actual point on the archer corresponding to the archer reference point. Viewed alone, this could indicate an anchor point misalignment or a misapplied torque to the riser. However, if in addition, the string axis and surface reference are seen as correctly aligned, misalignment of the archer reference point and alignment point would indicate a correct anchor-point placement, and a misapplied torque on the riser of the bow. In this manner, the archer can distinguish a misapplied torque to the riser from anchor-point misplacement. In summary, if the surface reference and string axis are correctly aligned, then the anchor point is correctly placed, and misalignment of the archer reference point and the alignment point would then be due to torque applied to the riser.

In preparing for a shot, the archer glances at the reflecting surface. As an example he may see a reflected image where the alignment point 143 and archer reference point 145 are not aligned, and the string axis 159 and surface reference 157 are not aligned, such as in FIG. 4 or FIG. 5. The archer would normally first adjust anchor-point placement to bring the string axis 159 and the surface reference 157 into alignment. If after this adjustment, the archer reference point 145 and alignment point 143 are not correctly aligned with each other, the archer may correct by adjusting the torque on the riser. At this point, the archer may have to make slight corrections in the anchor-point placement by reference to the alignment of the surface reference 157 and string axis 159. By readjusting the anchor-point and torque, as required, the alignment point 143 and archer reference point 145, and the surface reference 157 and the string axis 159 are brought into alignment as in FIG. 3.

Referring to FIGS. 1, 2, and 3, the alignment of the archer reference point, the alignment point, the string axis, and surface reference, determines the relative positions of four reference points on the shooting system; (1) the aiming eye 131 of the archer 101, (2) the point on the reflecting means corresponding to the archer reference point 145, (3) the actual point 147 on the archer corresponding to the archer reference point 145, and (4) the anchor point 111. The relative position between the aiming eye 131 of the archer 101 and the point 147 on the face corresponding to the archer reference point 145 is substantially fixed in an individual. Also, the angle of incidence at the reflecting means 129, at which the archer reference point is seen by the archer and aligned with the alignment point, is substantially constant. In addition, when the archer 101 draws to the anchor point 111, the draw length and hence the distances between the archer reference point 145 on the reflecting means 129 and the points on the archer 101, i.e., the point 147 corresponding to the archer reference point 145 and the aiming eye 131, are substantially fixed. Thus, when the alignment device and archer are aligned as described, the above four points (131, 145, 147, 111) are in substantially the same relative position from shot to shot. In addition, by being able to distinguish and correct of torque on the riser 105, the rotational position of the bow 103 is correct, and hence limb ends 161, 163 are not applying a force through string 109 to the rear of the arrow as it is released. Therefore, the archer is able to be more consistent in his shooting position, and, therefore, accuracy from shot to shot.

In contrast to the function of the alignment device of the invention, the above prior-art reflecting sights, by reflecting an image of the target to the archer, do not convey sufficient information to the archer to detect an incorrect shooting position. The sights generally cannot detect small misalignments, and cannot distinguish between torque and anchor-point problems. Consequently, defining the alignment of the shooting position of the archer and his relationship with the arrow and bow is more difficult to achieve through use of these sights.

In a less preferred embodiment of the invention, the reflected image seen through the alignment device may contain only a portion of the archer without a string axis provided by an image of the string or a surface reference on the reflecting surface. This embodiment may appear to the archer similar to FIG. 3, but without the image of the string. In this embodiment the alignment point and archer reference point are aligned to align the device. This embodiment is less preferred, because alignment of the alignment point and archer reference point alone conveys insufficient data to the archer to distinguish between torque and anchor point problems. However, even this embodiment is generally superior to the above prior-art reflective sights for determining alignment. This is because the distances between the reflecting surface, the archer's eye, and object reflected are relatively large, on the order of an arm's length. Accordingly, a smaller misalignment causes a larger movement in the reflected images and allows the archer to perceive small misalignments. In contrast, the above prior-art sights show misalignment by reflecting from the arrow, only a short distance from the reflecting surface, or in the case of periscope sights, from a secondary mirror, which is also a relatively short distance from the primary mirror. In addition, the secondary mirrors generally do not have any reference which would allow perception of a small misalignment. Accordingly, these sights are not as sensitive to misalignments as the present invention.

Figure 7:
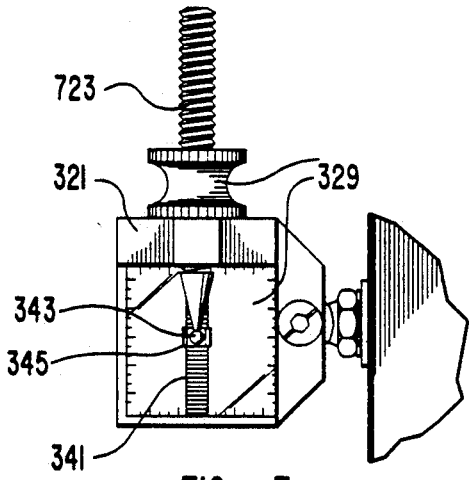
FIG. 7 is a view similar to that of FIG. 3, of an alternate embodiment of the invention.

In another less preferred embodiment, the reflecting surface is aligned to show a string reference point on the string in place of an archer reference point. In this embodiment, the string reference point is aligned with the alignment point instead of archer reference point. This embodiment has essentially the same features as the embodiment in the above paragraph, in that it can show misalignments, but not distinguish between anchor point and torque problems. However, this embodiment conveys additional information about draw length by showing an image of the string, since the mark will move up and down with various draw depths. In FIG. 7 is illustrated this embodiment from the view of the archer. The alignment device 321 comprises a reflecting means 329, which is adapted to show a reflected image 341 containing the string. While in shooting position, an alignment point 343, defined by a small sphere, is aligned with a string reference point 345, defined by a distinctive mark on the string image. The distinctive mark on the string image may be provided by marking the string in any suitable manner.

The alignment device of the invention is calibrated by moving or rotating the reflecting surface, such that when the archer is in a correct position, the image in the mirror shows alignment of the alignment point and archer reference point. The device may also be calibrated by moving the alignment point with respect to the reflecting means. In the preferred embodiment, the string axis and surface reference are also aligned when the archer is in correct shooting position.

A suitable method for calibration for the alignment device of the invention is for the archer to assume the shooting stance while looking into the alignement device. The reflecting means is moved and/or rotated, and/or the alignment point is moved until the desired image and alignment is achieved. Thereafter, when the archer sees the desired image from the reflecting means, the relative positions of the archer, bow, and arrow will be the same as during calibration of the device. Alignment is based on factors that are relatively constant for a given archer, which allows the present alignment device to be quite precisely calibrated for a correct shooting position.

Means for calibration, i.e., to rotate and/or move the reflecting means and optionally move the alignment point, may be any suitable means that permits a fine adjustment of the position of the reflecting means and alignment point.

In a preferred embodiment of the invention, the reflecting means is a planar reflector, with the archer reference point and surface reference either the same or close enough to each other to be seen in the same reflected portion of the archer. In this embodiment, both the archer reference point and the surface reference should preferably correspond to points on the body near the axis of a line passing from the reflecting means through the string, in order to enable the string and both points to be seen the reflecting means. Alternately, the image of the string portion with the surface reference may be provided by a reflecting means with two separate reflectors or prisms. This can be provided, for example, by two prisms, or two mirrored surfaces at an angle, or a single mirrored surface with half covered by a prism, to provide two reflecting surfaces for both reflected images.

The mounting means may be any suitable means for mounting the device to the bow. Preferably, the device is mounted near or in the aiming window, i.e., in the view of the archer as he aims. A preferred mounting means is adapted to mount the device on the bars used to mount conventional sighting or pins. This allows the archer to easily mount and remove the device, and does not require permanent modification of the bow. In addition, placement near the sighting pins places the device of the invention conveniently in view of the archer when sighting on a target.

The size of the device of the invention should be large enough to permit perception of the image in the reflecting means. In a suitable embodiment of the invention, the reflecting means is a square plane mirror, between about ⅜ inches (10 mm) and about 1 inch (25 mm), preferably about ½ inches (13 mm) square. Other shapes of similar size such as circular, avoid, and rectangular are also suitable. A smaller size may be suitable if the lighting is good and the eyesight of the archer is such that a perceivable image can be seen the reflecting means. Sizes larger than that required to provide a suitable reflected image are not preferred because the added weight and size only give a small improvement in the function of the device.

The alignment device of the invention may be used with any suitable sight to aim the arrow toward the target. A preferred sighting system is the conventional sighting bar with several sight or range pins. After the archer has correctly aligned the alignment device of the invention, he can then view the target and sight to aim. Another preferred sight used in conjunction with the present invention is a peep sight, which comprises an aiming aperture mounted on the bow-string. If a peep sight is used with the alignment device of the invention, the archer has a further indication of correct anchor point. However, to distinguish misapplication of torque, the archer would still require the device of the invention. The archer can also determine his draw length by observing the vertical position of the reflected image of string in the alignment device, preferably by observing the reflected image of a distinctive mark on the string.

Figure 8:
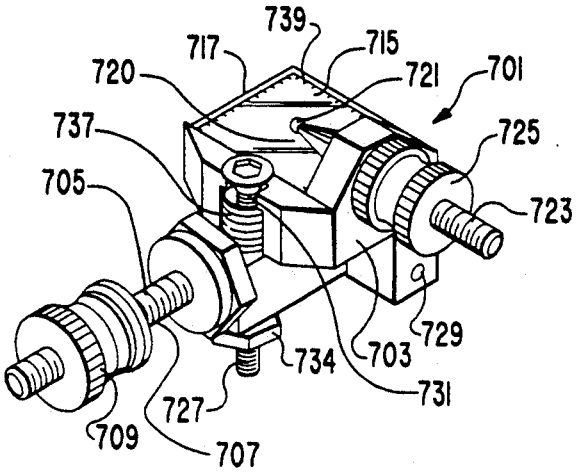
FIG. 8 is a perspective view of an alignment device of the invention.
Figure 9:
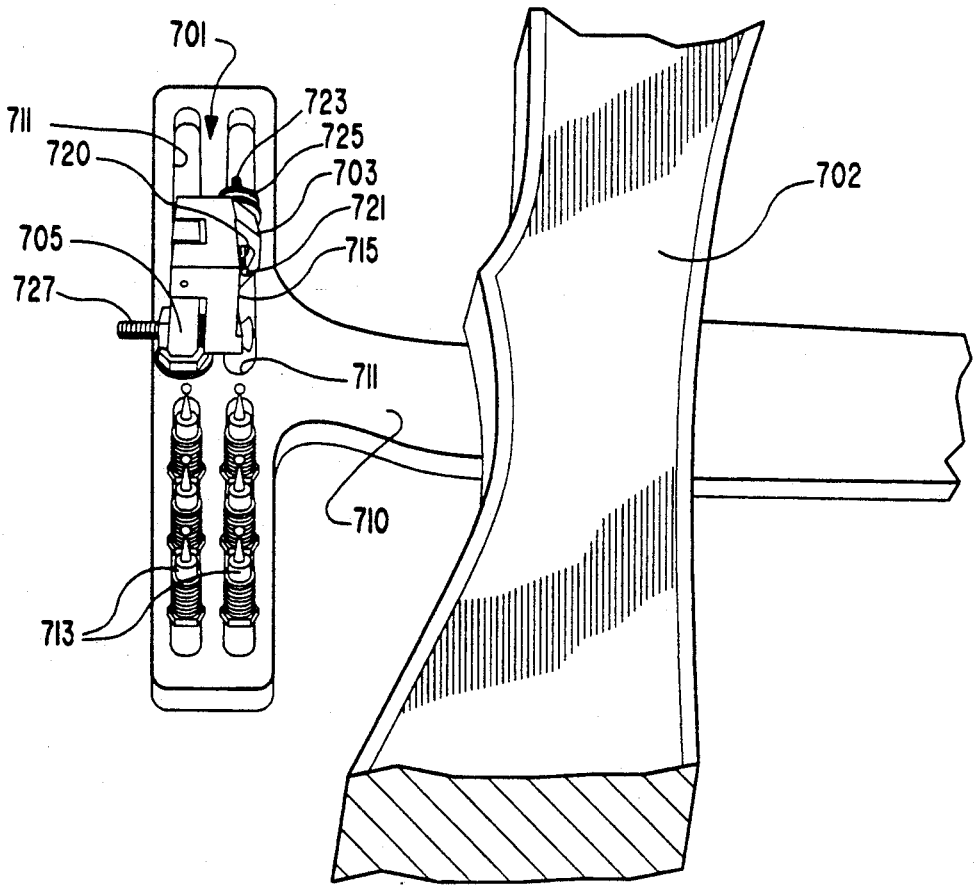
FIG. 9 is a perspective view of the alignment device in FIG. 8 mounted on a sight bar.
Figure 10A:
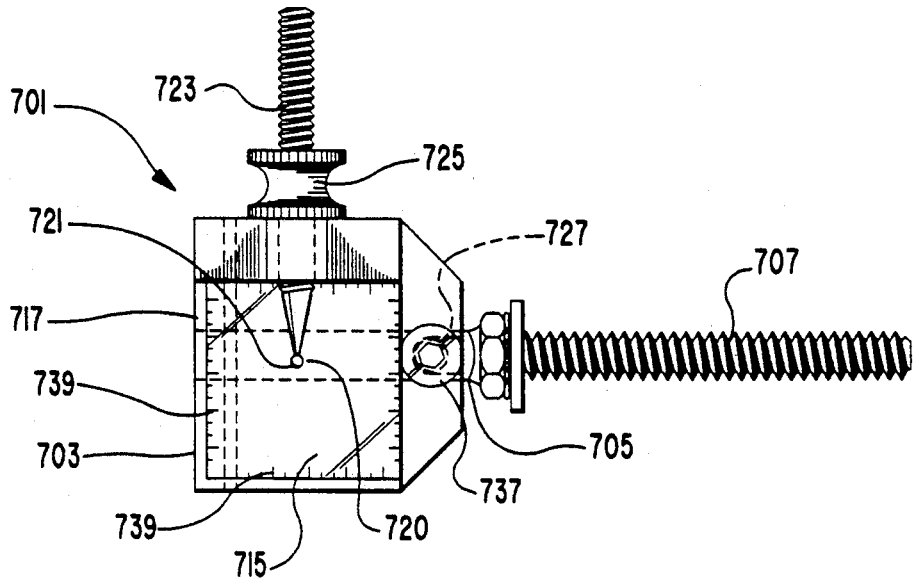
Figure 10B:
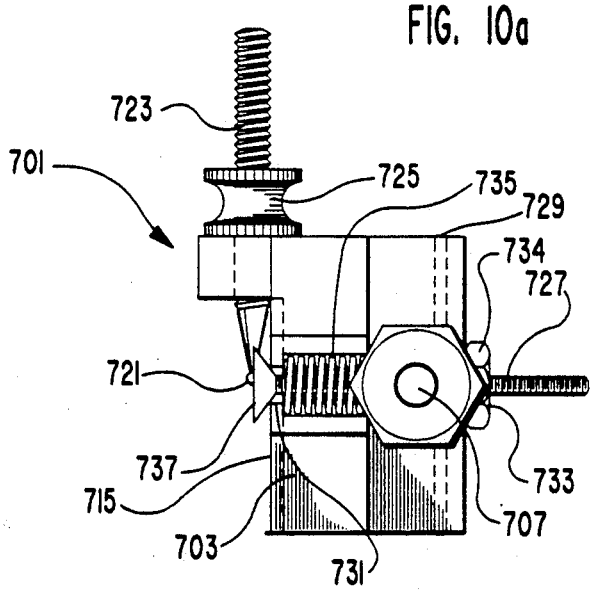
Figure 10C:
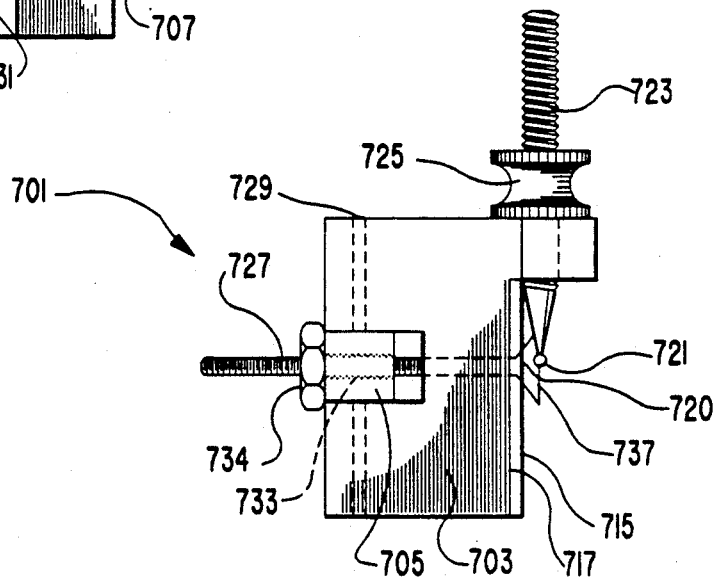

FIGS. 8, 9, and 10*a* to 10*d* show an alignment device of the invention. FIG. 8 is a perspective view showing the alignment device 701. FIG. 9 is a perspective view of the device 701 mounted on a bow 702. FIGS. 10*a*, 10*b*, 10*c*, and 10*d* are elevations viewed from the front, left and right sides, and a plan view from the bottom, respectively. Mounting means 705 of device 701 a threaded shaft 707 fitted with mounting nuts 709 to fit in mounting holes of a sighting pin mount. The mounting means 705 also comprises a body 703 which can be rotated on a first or vertical axis with respect to the mounting means 705.

In FIG. 9 is shown the alignment device mounted on the sight bar 710, with mounting holes 711, and conventional sighting pins 713. The sight bar 710 is mounted on bow 702. The alignment device may also be mounted directly on the riser by any suitable means, e.g., a screwed on mount with holes predrilled in the riser. I the alignment device 701 is mounted on the sight bar 710 together with sight pins 713 and/or leveling bubble (not shown), the alignment device 701 is preferably mounted on the top, and the sight pins 713 and levelling bubble below.

A reflecting means 715 is provided by a planar surface 717 of the body 703 of the device 701 that has been metallized or polished or has a glass mirror mounted thereon. The body 703 may be made any suitable material, such as metal or plastic. An alignment point 720 is defined on the reflecting means 715 by a small sphere 721 mounted directly in front of the reflecting means 715. The sphere 721 is mounted on a threaded post 723, which is screwed into a threaded nut 725 attached to the body 703. Optionally, reference marks 739 may be provided in the edges of the reflecting means 715 to assist the archer in aligning the device.

The angle of the reflecting means 715 can be calibrated by rotating it about a vertical axis and about a horizontal axis. For rough adjustments, the device 701 can be rotated about the horizontal axis by rotating the device 701 in the sight bar 710, and the device may be vertically moved on the mounting holes 711.

For fine adjustment of the alignment point 720 the threaded post 723 upon which the sphere 721 is mounted is rotated, moving the small sphere 721 along a vertical axis in front of the reflecting means 715.

The fine calibration of the reflecting means 715 can be accomplished by rotating it on a vertical axis by turning of adjustment screw 727. The body 703 is rotatably attached to the mounting means 705 by a vertical hinge pin 729, allowing the body 703 to rotate on the axis of the hinge pin 729. The adjustment screw 727 passes freely through a slot 731 in the body 703, and is then threaded into a threaded aperture 733 in the mounting means 705. A threaded locking nut 734 is used to lock the adjustment screw 727 after adjustment. A helical spring 735 around the adjustment screw 727 and between the body 703 and the mounting means 705 is biased to maintain the body 703 against the head 737 of the adjustment screw 727. Turning of the screw head 737 rotates the body 703 about the axis of the hinge pin 729.

Figure 11:
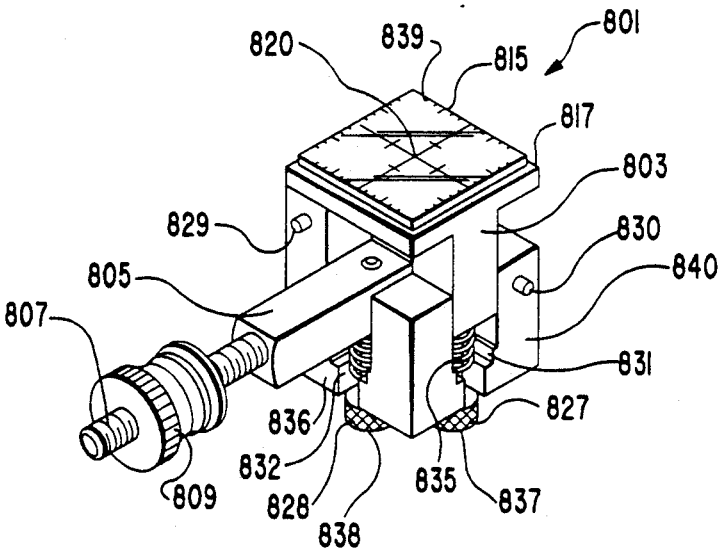
FIGS. 11, and 12 are perspective views of another embodiment of the alignment device of the invention.
Figure 12:
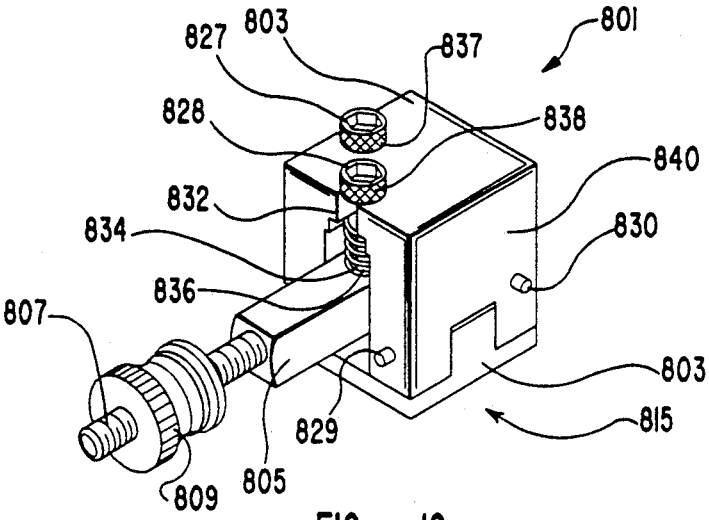
Figure 10D:
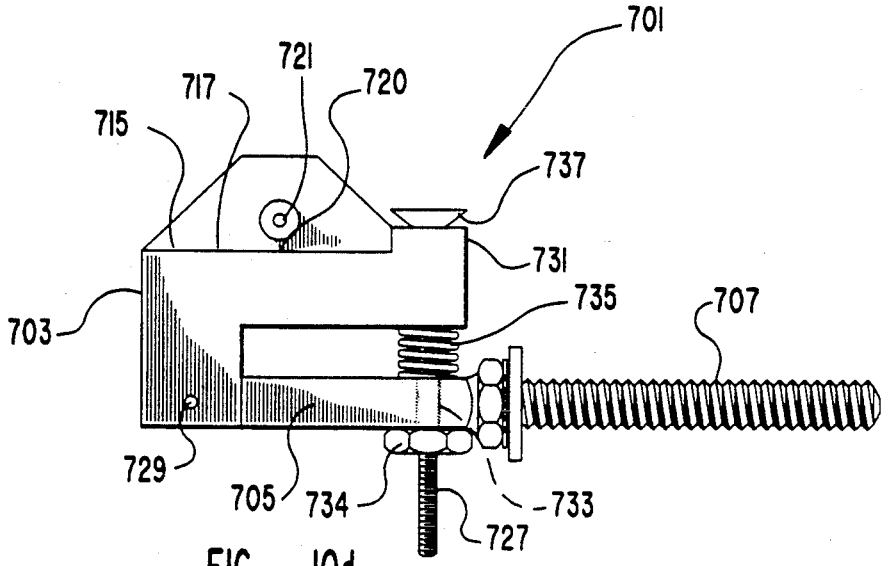
FIGS. 10*a*, 10*b*, 10*c*, and 10*d* are front, right side, left side, and bottom views, respectively, of the alignment device of FIG. 8.

FIGS. 11 and 12 illustrates another embodiment of the invention. In this embodiment the device 801 of the invention comprises a body 803 and a mounting means 805 adapted by a threaded shaft 807 and mounting nuts 809 for mounting on a bow. It may be mounted on a bow is a similar manner described above for the device in FIG. 9.

On the body 803 is reflecting means 815 in the form of a mirror mounted on a planar surface 817 of the body 803. An alignment point 820 is defined by a cross-hairs formed by etching away the reflecting medium from the back of the mirror, and applying an opaque paint on its back before it is mounted on the body 803. In addition to the cross-hairs, reference marks 839 are similarly applied on the edges of the reflecting means. The reference marks 839 can assist the archer aligning the device, and also provide one or more secondary alignment points, which are aligned with corresponding secondary archer or string reference points when the device is aligned in shooting position.

The device 801 is calibrated by rotating about a first horizontal axis and a second vertical axis substantially perpendicular to one another, by rotating horizontal axis adjustment screw 827 and the vertical axis adjustment screw 828, respectively. A pivot block 840 is pivotably attached by a vertical hinge pin 830 to the mounting means 805, and pivotably attached by a horizontal hinge pin 829 to the body 803, permitting the body 803 to pivot on both a vertical and horizontal axis with respect to the mounting means 805.

There is provided a first slot 831 in pivot block 840, with a first threaded aperture (not shown) in to the body 803, with the horizontal axis adjustment screw 829 screwed into the first threaded aperture, and extending through the first slot 831. The head 837 of the horizontal axis adjustment screw 827 prevents the screw from entering the first slot 831, and a first helical spring 835 between the body and the pivot block 840 is biased to urge the pivot block 840 against the head 837 of the horizontal axis adjustment screw 827. Turning of the horizontal axis adjustment screw head 837 pivots the body around the horizontal hinge pin 829.

There is also provided a second slot 832 in pivot block 840, with a second threaded aperture into the mounting means 805 at 834, with the vertical axis adjustment screw 828 screwed into the second threaded aperture, and extending through the second slot 832. The head 838 of the vertical axis adjustment screw 828 prevents the screw from entering the second slot 832, and a second helical spring 836 between the mounting means 805 and the pivot block 840 is biased to urge the pivot block 840 against the head 838 of the vertical adjustment screw 828. Turning of the vertical axis adjustment screw head 838 pivots the pivot block 840 around the vertical hinge pin 830 with respect to the mounting means 805.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A method for an archer for aligning an archery bow that has a tensioned bow string drawn by the archer, the method comprising:

(a) providing an alignment device mounted on the bow comprising a mounting means adapted to mount the device on the bow, a reflecting means attached to the mounting means, an alignment point proximate to the reflecting means, and a surface reference proximate to the reflecting surface, the reflecting means aligned in a manner such that when the device is mounted on the bow the reflecting means reflects an image of at least a portion of the archer and an image of at least a portion of the string to the aiming eye of the archer while the archer is in shooting position, (b) assuming a shooting position, (c) determining an archer reference point on the reflecting means by reference to a distinctive feature in the reflected image of the portion of the archer, and a vertically aligned string axis on the reflecting means by reference to a distinctive portion in the reflected image of the portion of the string, and (d) aligning the alignment point with the archer reference point, and the surface reference with the string axis.

2. A method for an archer for aligning an archery bow that has a tensioned bow string drawn by the archer, the method comprising;

(a) providing an alignment device mounted on the bow comprising a mounting means adapted to mount the device on the bow, a reflecting means attached to the mounting means, and an alignment point proximate to the reflecting means, the reflecting means aligned in a manner such that when the device is mounted on the bow the reflecting means reflects an image of at least a portion of the archer to the aiming eye of the archer while the archer is in shooting position, (b) assuming a shooting position, (c) determining an archer reference point of the reflecting means by reference to a distinctive feature in the reflected image of the portion of the archer, and (d) aligning the alignment point with the archer reference point.

3. A method for an archer for aligning an archery bow that has a tensioned bow string drawn by the archer, the method comprising:

(a) providing an alignment device mounted on the bow comprising a mounting means adapted to mount the device on the bow, a reflecting means attached to the mounting means, and a surface reference proximate to the reflecting surface, the reflecting means aligned in a manner such that when the device is mounted on the bow the reflecting means reflects an image of at least a portion of the string to the aiming eye of the archer while the archer is in shooting position, (b) assuming a shooting position, (c) determining a vertically aligned string axis on the reflecting means by reference to a distinctive portion in the reflected image of the portion of the string, and (d) aligning the surface reference with the string axis.

* * * * *